United States Patent [19]

Teuscher

[11] Patent Number: 4,464,450

[45] Date of Patent: Aug. 7, 1984

[54] MULTI-LAYER PHOTORECEPTOR CONTAINING SILOXANE ON A METAL OXIDE LAYER

[75] Inventor: Leon A. Teuscher, Webster, N.Y.

[73] Assignee: Xerox Corporation, Stamford, Conn.

[21] Appl. No.: 420,962

[22] Filed: Sep. 21, 1982

[51] Int. Cl.[3] ..... G03G 5/00; G03G 5/04

[52] U.S. Cl. ..... 430/59; 430/60; 430/65; 430/131

[58] Field of Search ..... 430/60, 64, 65, 59, 430/58, 131

[56] References Cited

U.S. PATENT DOCUMENTS

| | | | |
|---|---|---|---|
| 3,312,547 | 4/1967 | Levy | 96/1.5 |
| 3,453,106 | 7/1969 | Teague, Jr. | 96/1.5 |
| 4,047,949 | 9/1977 | Horgan | 96/1.5 R |
| 4,081,274 | 3/1978 | Horgan | 96/1 PC |
| 4,115,116 | 9/1978 | Stolka et al. | 96/1.5 R |
| 4,265,990 | 5/1981 | Stolka et al. | 430/59 |
| 4,291,110 | 9/1981 | Lee | 430/59 |

FOREIGN PATENT DOCUMENTS

| | | |
|---|---|---|
| 7599326 | 5/1976 | Japan . |
| 7512574 | 8/1976 | Japan . |
| 54-43732 | 6/1979 | Japan . |
| 54-160104 | 12/1979 | Japan . |
| 55-32519 | 3/1980 | Japan . |

OTHER PUBLICATIONS

IBM Technical Disclosure Bulletin, vol. 23, No. 11, p. 5102, 4/81.

Boerio, Polymer Preprint, vol. 22, No. 1, 3/81, p. 297.

*Primary Examiner*—John E. Kittle

*Assistant Examiner*—John L. Goodrow

*Attorney, Agent, or Firm*—Peter H. Kondo

[57] ABSTRACT

An electrostatographic imaging member having two electrically operative layers including a charge transport layer and a charge generating layer, the electrically operative layers overlying a siloxane film coated on a metal oxide layer of a metal conductive anode, said siloxane film comprising a reaction product of a hydrolyzed silane having the following general formula:

wherein $R_1$ is an alkylidene group containing 1 to 20 carbon atoms, and $R_2$ and $R_3$, are independently selected from the group consisting of H, a lower alkyl group containing 1 to 3 carbon atoms, a phenyl group, and a poly(ethylene-amino) group, said siloxane having reactive OH and ammonium groups attached to silicon atoms.

20 Claims, 7 Drawing Figures

MULTI-LAYER PHOTORECEPTOR CONTAINING SILOXANE ON A METAL OXIDE LAYER

BACKGROUND OF THE INVENTION

This invention relates in general to electrostatography and, more specifically, to a novel photoconductive device and processes for preparing and using the device.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind an electrostatic latent image in the nonilluminated areas. This electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the anode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain diamine compound. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in co-pending U.S. application entitled "Layered Photoresponsive Imaging Devices," Ser. No. 420,961, filed in the names of Leon A. Teusher, Frank Y. Pan and Ian D. Morrison on the same date as the instant application. The disclosures of this co-pending application and the aforesaid U.S. Pat. No. 4,265,990 are incorporated herein in their entirety. Photosensitive members having at least two electrically operative layers as disclosed above provide excellent images when charged with a uniform negative electrostatic charge, exposed to a light image and thereafter developed with finely developed electroscopic marking particles. However, when the supporting conductive substrate comprises a metal having an outer oxide surface such as aluminum oxide, difficulties have been encountered with these photosensitive members under extended electrostatographic cycling conditions found in high volume, high speed copiers, duplicators and printers. For example, it has been found that when certain charge generation layers comprising a resin and a particulate photoconductor are adjacent an aluminum oxide layer of an aluminum electrode, the phenomenon of "cycling-up" is encountered. Cycling-up is the build-up of residual potential through repeated electrophotographic cycling. Build-up of residual potential can gradually increase under extended cycling to as high, for example, as 300 volts. Residual potential causes the surface voltage to increase accordingly. Build-up of residual potential and surface voltage causes ghosting, increased background on final copies and cannot be tolerated in precision high-speed, high-volume copiers, duplicators, and printers.

It has also been found that photosensitive members having a homogeneous generator layer such as $As_2Se_3$ such as those disclosed in U.S. Pat. No. 4,265,990, exhibit "cycling-down" of surface voltage when exposed to high cycling conditions found in high speed, high volume copiers, duplicators and printers. When cycling-down occurs the surface voltage and charge acceptance decrease as the dark decay increases in the areas exposed and the contrast potential for good images degrades and causes faded images. This is an undesirable fatigue-like problem and is unacceptable for high speed, high volume applications.

Thus, the characteristics of photosensitive members comprising an anode electrode and at least two electrically operative layers, which are utilized in negative charging imaging systems, exhibit deficiencies under extended cycling conditions in high volume, high speed copiers, duplicators, and printers.

SUMMARY OF THE INVENTION

It is an object of the invention to provide an imaging member having at least two electrically operative layers, including a charge generating layer and a contiguous charge transport layer, overlying a siloxane film of a reaction product of a hydrolyzed silane coated on a metal oxide layer of a conductive metal anode, the hydrolyzed silane having the general formula:

I.

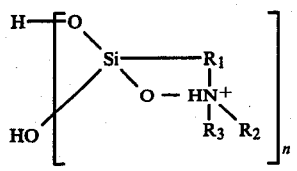

II.

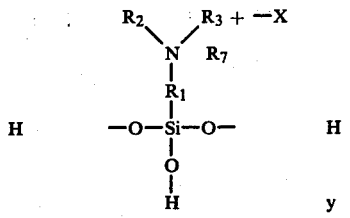

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1, 2, 3 or 4, and y is 1, 2, 3 or 4. The imaging member is prepared by depositing on the metal oxide layer of a metallic conductive anode layer a coating of an aqueous solution of the hydrolyzed silane at a pH between about 4 and about 10, drying the reaction product layer to form a siloxane film and applying the electrically operative layers to the siloxane film.

BRIEF DESCRIPTION OF THE DRAWINGS

A more complete understanding of the processes and device of the present invention can be obtained by reference to the accompanying drawings wherein.

Figure 1:
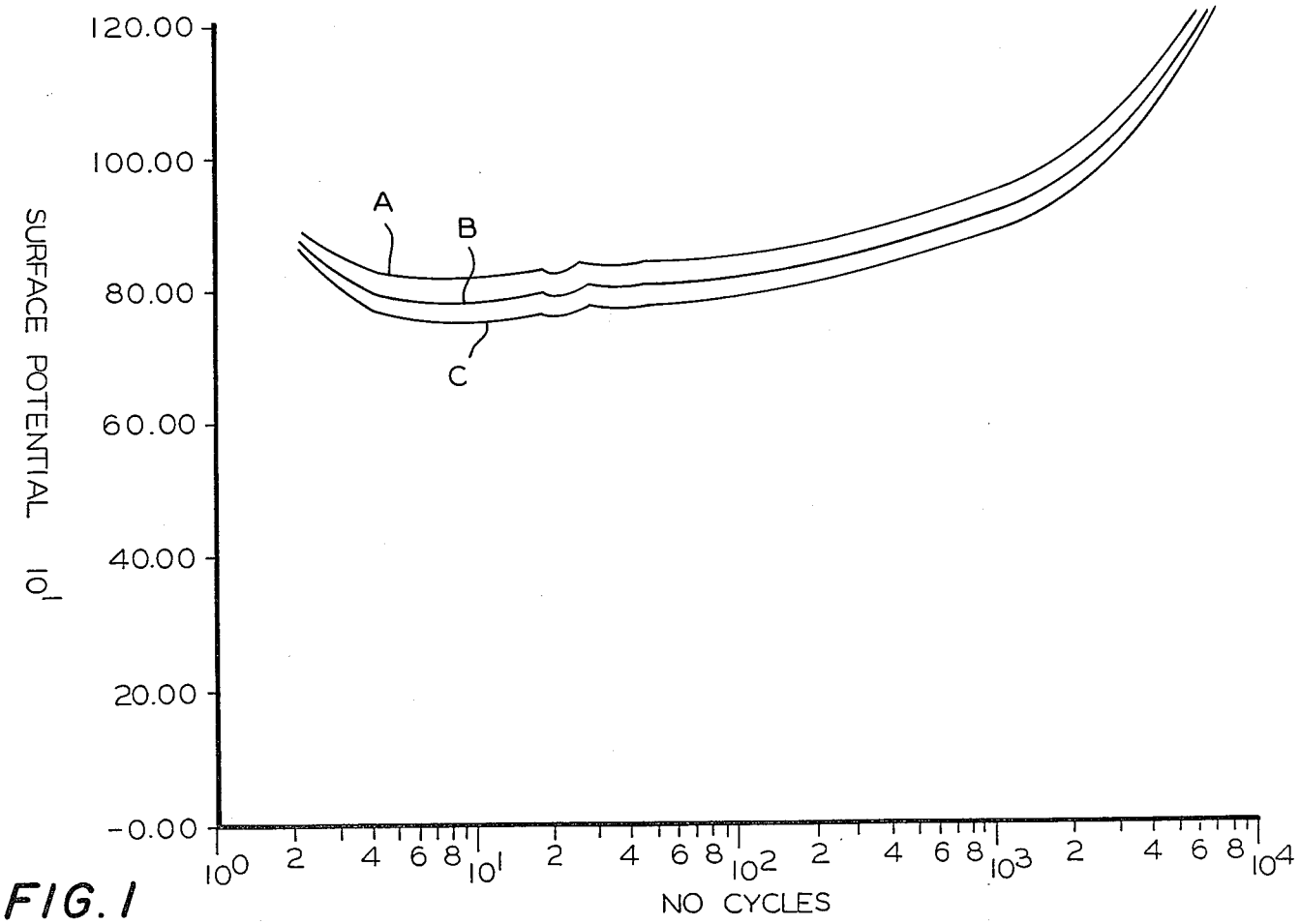
FIG. 1 graphically illustrates cycling-up characteristics with a photosensitive member having two electrically operative layers on a metal oxide layer of a conductive metal anode layer.

The hydrolyzed silane may be prepared by hydrolyzing a silane having the following structural formula:

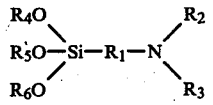

wherein $R_1$ is an alkylidene group containing 1 to 20 carbon atoms, $R_2$ and $R_3$ are independently selected from H, a lower alkyl group containing 1 to 3 carbon atoms, a phenyl group and a poly(ethylene-amino) group, and $R_4$, $R_5$ and $R_6$ are independently selected from a lower alkyl group containing 1 to 4 carbon atoms. Typical hydrolyzable silanes include 3-aminopropyl triethoxy silane, N-aminoethyl-3-aminopropyl trimethoxy silane, 3-aminopropyl trimethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

If $R_1$ is extended into a long chain, the compound becomes less stable. Silanes in which $R_1$ contains about 3 to about 6 carbon atoms are preferred because the molecule is more stable, is more flexible and is under less strain. Optimum results are achieved when $R_1$ contains 3 carbon atoms. Satisfactory results are achieved when $R_2$ and $R_3$ are alkyl groups. Optimum smooth and uniform films are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate general structure:

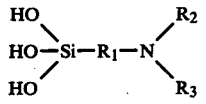

After drying, the siloxane reaction product film formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution may be prepared be adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.1 percent by weight to about 1.5 percent by weight of the silane based on the total weight of the solution. A solution containing from about 0.05 percent by weight to about 0.2 percent by weight silane based on the total weight of solution are preferred for stable solutions which form uniform reaction product layers.

It is critical that the pH of the solution of hydrolyzed silane be carefully controlled to obtain optimum electrical stability. A solution pH between about 4 and about 10 is preferred. Thick reaction product layers are difficult to form at solution pH greater than about 10. Moreover, the reaction product film flexibility is also adversely affected when utilizing solutions having a pH greater than about 10. Further, hydrolyzed silane solutions having a pH greater than about 10 or less than about 4 tend to severely corrode metallic conductive anode layers such as those containing aluminum during storage of finished photoreceptor products. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

If desired, the aqueous solution of hydrolyzed silane may also contain additives such as polar solvents other than water to promote improved wetting of the metal oxide layer of metallic conductive anode layers. Improved wetting ensures greater uniformity of reaction between the hydrolyzed silane and the metal oxide layer. Any suitable polar solvent additive may be employed. Typical polar solvents include methanol, ethanol, isopropanol, tetrahydrofuran, methylcellusolve, ethylcellsolve, ethoxyethanol, ethylacetate, ethylformate and mixtures thereof. Optimum wetting is achieved with ethanol as the polar solvent additive. Generally, the amount of polar solvent added to the hydrolyzed silane solution is less than about 95 percent based on the total weight of the solution.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane insitu by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more nonconducting and residual charge tends to increase because of trapping of electrons and thicker reaction product films tend to become brittle prior to the point where increases in residual charges become unacceptable. A brittle coating is, of course, not suitable for flexible photoreceptors, particularly in high speed, high volume copiers, duplicators and printers.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Generally, increasing the reaction time increases the degree of cross-linking of the hydrolyzed silane. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at sub-atmospheric pressures.

One may readily determine whether sufficient condensation and cross-linking has occurred to form a siloxane reaction product film having stable electric chemical properties in a machine environment by merely washing the siloxane reaction product film with water, toluene, tetrahydrofuran, methylene chloride or cyclohexanone and examining the washed siloxane reaction product film to compare infrared absorption of Si—O— wavelength bands between about 1,000 to about 1,200 $cm^{-1}$. If the Si—O— wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer.

Any suitable metallic conductive anode layer having an exposed metal oxide layer may be treated with the hydrolyzed silane. Typical conductive layers include aluminum, chrominum, nickel, indium, tin, gold and mixtures thereof. The conductive layer and metal oxide layer may be of any suitable configuration such as that of webs, sheets, plates, drums, and the like. The metallic conductive anode layer may be supported by any underlying flexible, rigid, uncoated and pre-coated member as desired. The support member may be of any suitable material including metal, plastics and the like.

In order to reduce high cycling-up and to minimize cycling-down at low humidities with the siloxane reaction product film of this invention, the metallic conductive layers should be employed as an anode and the photosensitive member should be charged with a uniform negative charge prior to imagewise exposure. Generally, the photosensitive member having at least two electrically operative layers, i.e. at least one charge transport layer and at least one generating layer, is charged with a negative charge and utilizes a metallic conductive anode layer when a hole generator layer is sandwiched between the metallic conductive anode layer and the hole transport layer or when an electron transport layer is sandwiched between a metallic conductive anode layer and an electron generating layer.

Any suitable combination of these two electrically operative layers may be utilized with the reaction product of the hydrolyzed silane and metal oxide layer of a metallic conductive anode layer of this invention so long as the combination is capable of accepting a uniform negative charge on the imaging surface thereof prior to imagewise exposure for forming negatively charged electrostatic latent images. Numerous combinations having at least two electrically operative layers in this type of photosensitive member are known in the art. Specific examples of photosensitive members having at least two electrically operative layers in which a metallic conductive layer is an anode and which are charged with a uniform negative charge prior to imagewise exposure include those photosensitive members disclosed in U.S. Pat. No. 4,265,990 and in copending application entitled "Layered Photoresponsive Imaging Devices, "Ser. No. 420,961, filed in the names of Leon A. Teuscher, Frank Y. Pan and Ian D. Morrison on the same date as the instant application the disclosures of which are incorporated herein in their entirety.

Excellent results in minimizing cycling-down effects and cycling-up effects have been achieved when the siloxane reaction product film is employed in imaging members comprising a charge generation layer comprising a layer of photoconductive material and a contiguous charge transport layer of a polycarbonate resin material having a molecular weight of from about 20,000 to about 120,000 having dispersed therein from about 25 to about 75 percent by weight of one or more compounds having the general formula:

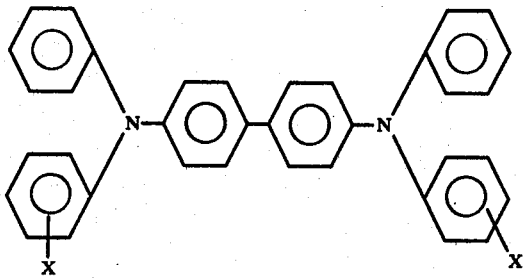

wherein X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting said holes through the charge transport layer. Other examples of charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis(diethylamino)-2',2''-dimethyltriphenyl methane and the like dispersed in an inactive resin binder.

Numerous inactive resin binder materials may be employed in the charge transport layer including those described, for example, in U.S. Pat. No. 3,121,006, the entire disclosure of which is incorporated herein by reference. The resinous binder for the charge transport layer may be identical to the resinous binder material employed in the charge generating layer. Typical organic resinous binders include polycarbonates, acrylate polymers, vinyl polymers, cellulose polymers, polyesters, polysiloxanes, polyamides, polyurethanes, epoxies, and the like. These polymers may be block, random or alternating copolymers. Excellent results have been achieved with a resinous binder material comprised of a poly(hydroxyether) material selected from the group consisting of those of the following formulas:

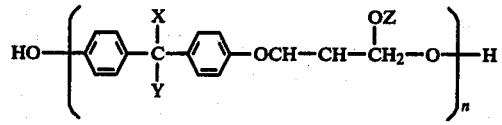

I.

and

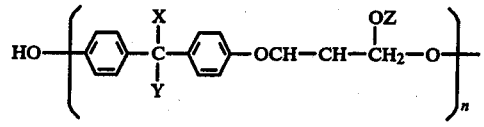

II.

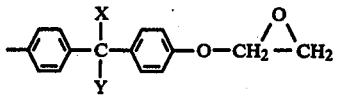

wherein X and Y are independently selected from the group consisting of aliphatic groups and aromatic groups, Z is hydrogen, an aliphatic group, or an aromatic group, and n is a number of from about 50 to about 200.

These poly(hydroxyethers), some of which are commercially available from Union Carbide Corporation, are generally described in the literature as phenoxy resins, or epoxy resins.

Examples of aliphatic groups for the poly(hydroxyethers), include those containing from about 1 carbon atom to about 30 carbon atoms, such as methyl, ethyl, propyl, butyl, pentyl, hexyl, heptyl, decyl, pentadecyl, eicodecyl, and the like. Preferred aliphatic groups include alkyl groups containing from about 1 carbon atom to about 6 carbon atoms, such as methyl, ethyl, propyl, and butyl. Illustrative examples of aromatic groups include those containing from about 6 carbon atoms to about 25 carbon atoms, such as phenyl, napthyl, anthryl and the like, with phenyl being preferred. Encompassed within the present invention are aliphatic and aromatic groups which can be substituted with various known substituents, including for example, alkyl, halogen, nitro, sulfo, and the like.

Examples of the Z substituent include hydrogen, as well as aliphatic, aromatic, substituted aliphatic, and substituted aromatic groups as defined herein. Furthermore, Z can be selected from carboxyl, carbonyl, carbonate, and other similar groups, resulting in for example, the corresponding esters, and carbonates of the poly(hydroxyethers).

Preferred poly(hydroxyethers) include those wherein X and Y are alkyl groups, such as methyl, Z is hydrogen or a carbonate group, and n is a number ranging from about 75 to about 100. Specific preferred poly(hydroxyethers) include Bakelite, phenoxy resins, PKHH, commercially available from Union Carbide Corporation and resulting from the reaction of 2,2-bis(4-hydroxyphenylpropane, or bisphenol A, with epichlorohydrin, an epoxy resin, Araldite ®6097, commercially available from CIBA, the phenylcarbonate of the poly(hydroxyether), wherein Z is a carbonate grouping, which material is commercially available from Allied Chemical Corporation, as well as poly(hydroxyethers) derived from dichloro bis phenol A, tetrachloro bis phenol A, tetrabromo bis phenol A, bis phenol F, bis phenol ACP, bis phenol L, bis phenol V, bis phenol S, and the like and epichlorohydrins.

The photogenerating layer containing photoconductive compositions and/or pigments, and the resinous binder material generally ranges in thickness of from about 0.1 micron to about 5.0 microns, and preferably has a thickness of from about 0.3 micron to about 1 micron. Thicknesses outside these ranges can be selected providing the objectives of the present invention are achieved.

The photogenerating composition or pigment is present in the poly(hydroxyether) resinous binder composition in various amounts, generally, however, from about 10 percent by volume to about 60 percent by volume of the photogenerating pigment is dispersed in about 40 percent by volume to about 90 percent by volume of the poly(hydroxyether) binder, and preferably from about 20 percent to about 30 percent by volume of the photogenerating pigment is dispersed in from about 70 percent by volume to about 80 percent by volume of the poly(hydroxyether) binder composition. In one very preferred embodiment of the present invention, 25 percent by volume of the photogenerating pigment is dispersed in 75 percent by volume of the poly(hydroxyether) binder composition.

Interestingly, it has been found that if a layer of photoconductive material utilized with the contiguous polycarbonate charge transport layer described above contains trigonal selenium particles dispersed in polyvinylcarbazole, unacceptable cycling-down occurs during extended cycling at low humidity, whereas undesirable cycling-up occurs during extended cycling when the photoconductive layer employed with the contiguous polycarbonate transport layer described above is a layer of trigonal selenium particles dispersed in a poly(hydroxyether) resin or a vacuum deposited homogeneous layer of $As_2Se_3$.

Other typical photoconductive layers include amorphous or alloys of selenium such as selenium-arsenic, selenium-tellurium-arsenic, and selenium-tellurium.

Generally, the thickness of the transport layer is between about 5 to about 100 microns, but thicknesses outside this range can also be used. If the generator layer is sandwiched between the siloxane reaction product film and the charge transport layer, the charge transport layer is normally non-absorbing to light in the wavelength region employed to generate carriers in the photoconductive charge generating layer. However, if the conductive anode layer is substantially transparent, imagewise exposure may be effected from the conductive anode layer side of the sandwich. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

In some cases, intermediate layers between the siloxane reaction product film and the adjacent generator or transport layer may be desired to improve adhesion or to act as an electrical barrier layer. If such layers are utilized, they preferably have a dry thickness between about 0.1 micron to about 5 microns. Typical adhesive layers include film-forming polymers such as polyester, polyvinylbutyral, polyvinylpyrolidone, polyurethane, polymethyl methacrylate and the like.

Optionally, an overcoat layer may also be utilized to improve resistance to abrasion. These overcoating layers may comprise organic polymers or inorganic polymers that are electrically insulating or slightly semiconductive.

It is theorized that the improved results achieved with the siloxane reaction product film are achieved by retardation through trapping of migrating metal cations from the metallic conductive anode layer into the adjacent electrically operative layer during extensive electrical cycling. It is believed that the siloxane reaction product film captures the metal cations migrating from the anodic metallic conductive anode layer by reaction between the metal cations and free OH groups and ammonium groups attached to the silicon atoms of the siloxane thereby stabilizing the electrochemical reaction occurring thereon during extended electrical cycling. Evidence of migration of metal cations is observed in the disappearance of the shiny vacuum deposited aluminum conductive anode layer when untreated photoreceptors described in Example I below are cycled for more than 150,000 cycles. Further, SEM analysis indicate the presence of metal cations in the electrically operative layer adjacent the anodic electrode in untreated photoreceptors and significantly fewer metal cations in the adjacent electrically operative layer when the siloxane reaction product film of this invention is utilized in the photoreceptor. The trapping of metal cations at the siloxane film markedly stabilizes electrical properties during extended cycling by preventing most metal cations from proceeding into and adversely contaminating the adjacent electrically operative layer.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

About 1.5 grams of a dispersion of 33 volume percent trigonal selenium having a particle size between about 0.05 micron to about 0.20 microns and about 67 volume percent of poly(hydroxyether) resin, Bakelite phenoxy PKHH available from Union Carbide Corporation is added to about 2.5 grams of a solution of tetrahydrofuran containing about 0.025 grams of N,N'-diphenyl-N,N'-bis(3-methylphenyl)1,1'-biphenyl-4,4'-diamine. This mixture was applied with a 0.0005 inch Bird applicator to an aluminized polyester film, Mylar, in which the aluminum had a thickness of about 150 Angstroms. The outer surface of the aluminum had been oxidized from exposure to ambient air. The device was then allowed to dry at 135° C. for 3 minutes resulting in the formation of a hole generating layer having a dry thickness of about 0.6 micron containing about 28 volume percent of trigonal selenium dispersed in about 72 volume percent of poly(hydroxyether). The generating layer was then overcoated with a 25 micron thick charge transport layer containing about 50 percent by weight N,N'-diphenyl-N,N'-bis(3-methylphenyl)1,1'-biphenyl-4,4'-diamine dispersed in about 50 percent by weight of polycarbonate resin, Makrolon, available from Bayer Corporation. The resulting photosensitive member having two electrically operative layers is subjected to electrical cycling in a continuous rotating scanner for about 10,000 cycles. The continuously rotating scanner subjected the photosensitive member fastened to a drum having a 30 inch circumference rotated at 30 inches per second to electrical charging and discharging during each complete rotation. During each complete 360° rotation, charging occured at 0°, charging surface potential was measured at 22.5°, light exposure was effected at 56.25°, discharged surface potential measured at 78.75°, development surface potential measured at 236.25°, and erase exposure was effected at 258.75°.

The results of the scanning test, plotting surface potential to number of cycles, is illustrated in FIG. 1. Curve A shows the surface potential about 0.06 second after charging. Curve 2 shows surface potential after light exposure about 0.2 second after charging. Curve C shows the surface potential after development about 0.6 second after charging. As evidenced from the curves, the surface potential increases dramatically with number of cycles and renders the photosensitive member unacceptable for making quality images in precision, high volume, high speed copiers, duplicators and printers unless expensive sophisticated equipment is employed to compensate for the large change in surface charge.

EXAMPLE II

Figure 2:
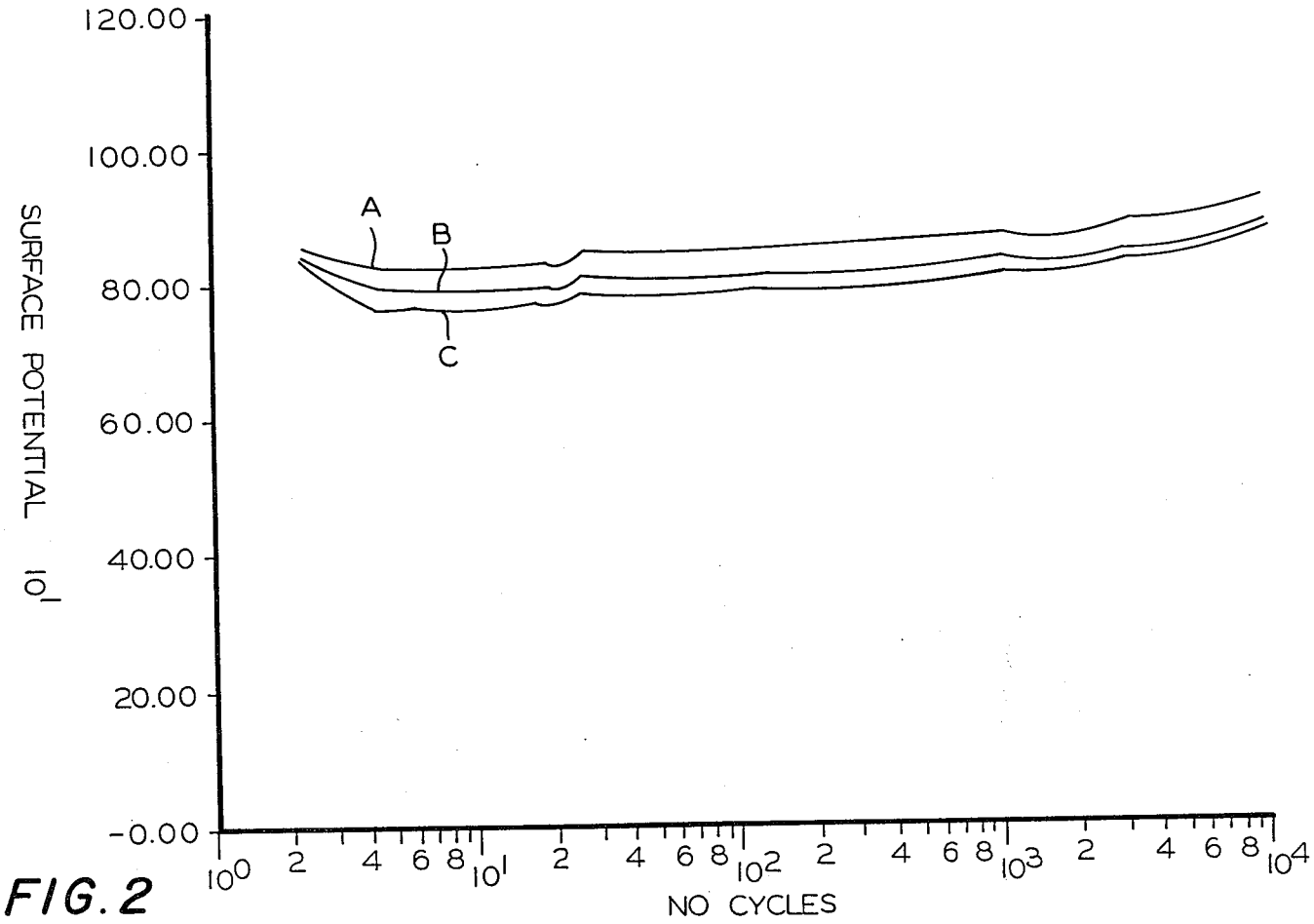
FIG. 2 graphically illustrates the effect on cycling of a photosensitive member in which a siloxane film is interposed between a metal oxide layer of a conductive metal anode layer and two electrically operative layers.

An aqueous solution was prepared containing about 0.44 percent by weight based on the total weight of the solution (0.002 mole solution), of 3-aminopropyl triethoxylsilane. The solution also contained about 95 percent by weight denatured ethanol and about 5 percent by weight isopropanol based on the total weight of the solution (0.002 mole solution). This solution had a pH of about 10 and was applied with a 0.0005 inch Bird applicator onto the surface of an aluminized polyester film Mylar and thereafter dried at a temperature of about 135° C. in a forced air oven for about 3 minutes to form a reaction product layer of the partially polymerized silane upon the aluminum oxide layer of the aluminized polyester film to form a dried layer having a thickness of about 150 Angstroms measured by infrared reflectance spectrometry and by ellipsometry. The hole generating layer and hole transport layer described in Example I are then applied to the reaction product layer of the hydrolyzed silane in the same manner as that described in Example I. The resulting photosensitive member having two electrically operative layers is subjected to electrical cycling in a continuous rotating scanner for about 10,000 cycles as described in Example I. The results of the scanning test, plotting surface potential to number of cycles, is illustrated in FIG. 2. Curve A shows surface potential about 0.06 second after charging. Curve B shows the surface potential after imagewise exposure about 0.2 second after charging. Curve C shows the surface potential after development about 0.6 second after charging. As evidenced from the curves, the excessive surface potential increase with number of cycles of the device of Example I is reduced dramatically and renders the photosensitive member acceptable for making quality images under extended cycling conditions in precision, high volume, high speed copiers, duplicators and printers without the need for expensive, sophisticated equipment to compensate for changes in surface charge.

EXAMPLE III

Figure 3:
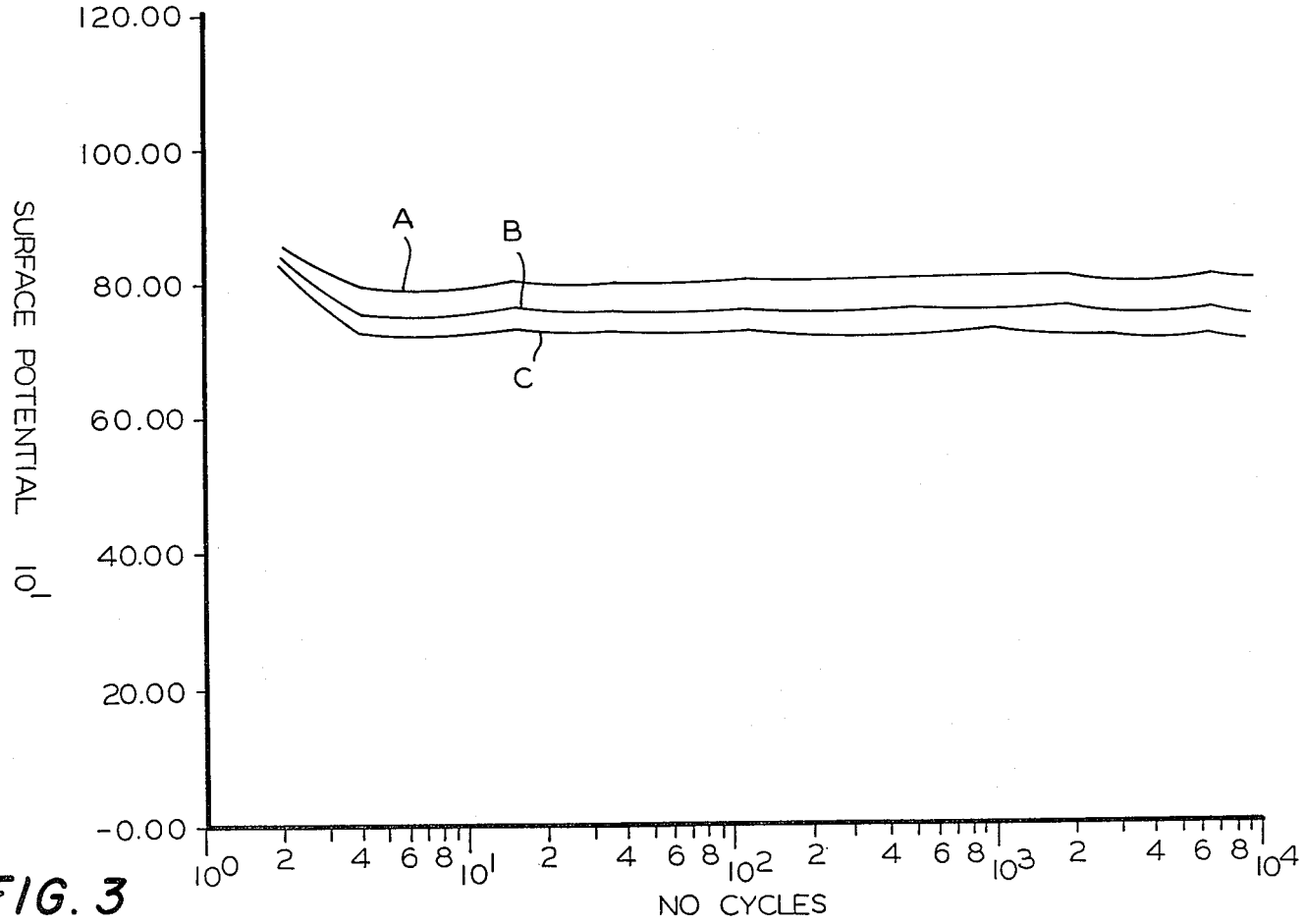
FIG. 3 graphically illustrates another embodiment involving the effect on cycling of a photosensitive member in which a siloxane film is interposed between a metal oxide layer of a conductive metal anode layer and two electrically operative layers.

An aqueous solution was prepared containing about 0.44 percent by weight based on the total weight of the solution (0.002 mole solution), of 3-aminopropyl triethoxylsilane. The solution also contained about 5 percent by weight denatured ethanol and about 5 percent by weight isopropanol based on the total weight of the solution of 0.0004. Hydrogen iodide was added to the solution to bring the pH to about 7.3. This solution was applied with a 0.0005 Bird bar onto the aluminized polyester film, Mylar, and thereafter dried at a temperature of about 135° C. in a forced air oven for about 3 minutes to form a reaction product layer of the partially polymerized siloxane upon the aluminum oxide layer of the aluminized polyester film to form a dried layer having a thickness of about 140 Angstroms, measured by infrared reflectance, spectrophotometry and ellipsometry. The hole generating layer and hole transport layer described in Example I are then applied to the reaction product layer formed from the hydrolyzed silane in the same manner as that described in Example I. The resulting photosensitive member having two electrically operative layers is subjected to electrical cycling in a continuous rotating scanner for about 10,000 cycles as described in Example I. The results of the scanning test, plotting surface potential to number of cycles, is illustrated in FIG. 3. Curve A shows surface potential about 0.06 second after charging. Curve B shows the surface potential after imagewise exposure about 0.2 second after charging. Curve C shows the surface potential after development about 0.6 second after charging. As evidenced from the curves, the excessive surface potential increase with number of cycles exhibited by the device of Example I was reduced dramatically and rendered the treated photosensitive member acceptable for making quality images under extended cycling conditions in precision, high volume, high speed copiers, duplicators and printers without the need for expensive, sophisticated equipment to compensate for changes in surface charge.

EXAMPLE IV

Figure 4:
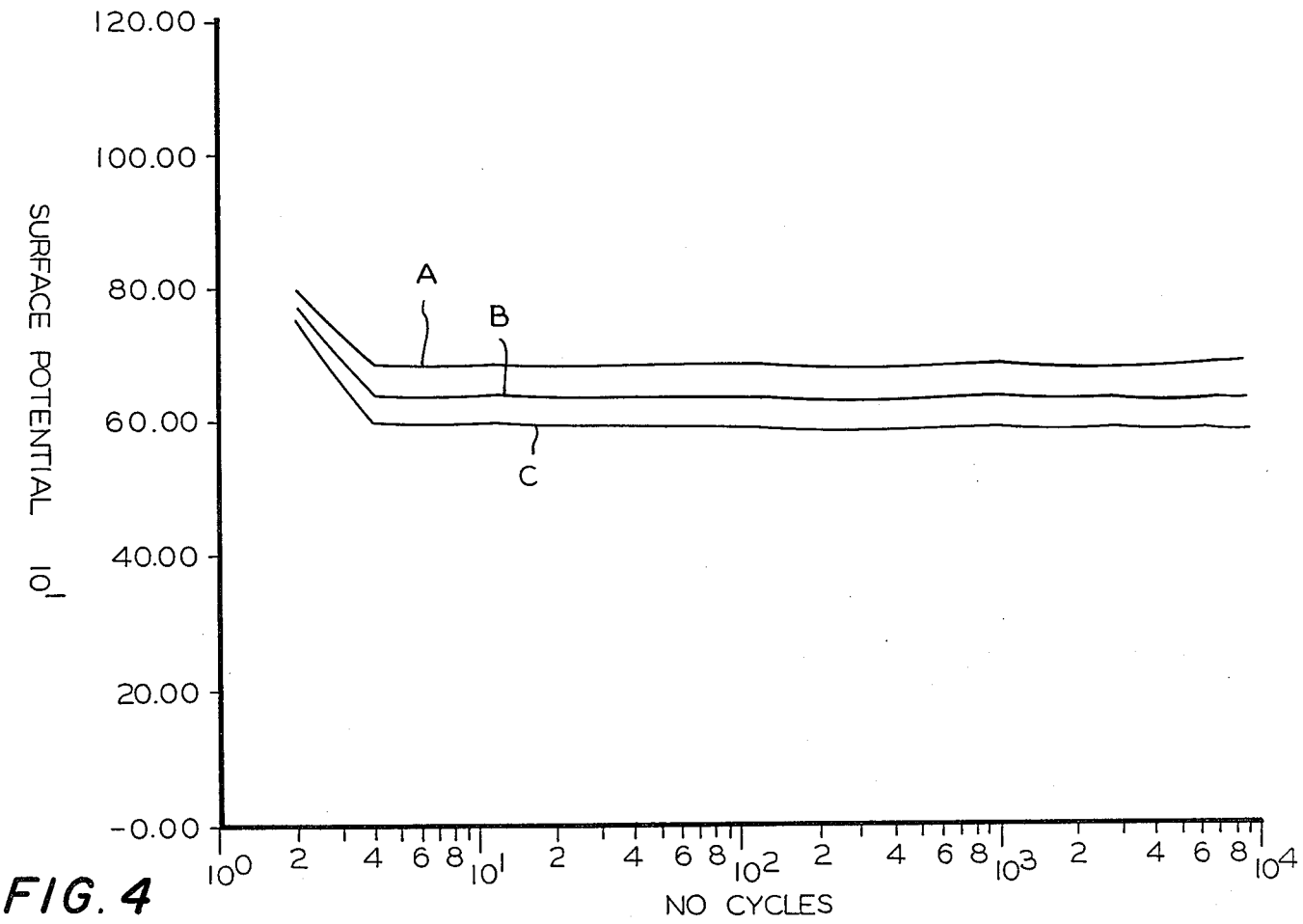
FIG. 4 graphically illustrates another embodiment involving the effect on cycling of a photosensitive member in which a siloxane film is interposed between a metal oxide layer of a conductive metal anode layer and at least two electrically operative layers.

An aqueous solution was prepared containing about 0.44 percent by weight based on the total weight of the solution or 0.002 mole, of 3-aminopropyl triethoxysilane. The solution also contained about 95 percent by weight denatured ethanol 3A and about 5 percent by weight isopropanol based on the total weight of the solution 0.001 mole. Hydrogen iodide was added to the solution to bring the pH to about 4.5. This solution was applied with a 0.0005 Bird bar onto the surface of an aluminized polyester film, Mylar, and thereafter dried at a temperature of about 135° C. in a forced air oven for about 3 minutes to form a siloxane reaction product film from the hydrolyzed silane having a dry thickness of about 140 Angstroms measured by infrared reflectance, spectrometry or by ellipsometry. The hole generating layer and hole transport layer described in Example I are then applied to the siloxane reaction product film in the same manner as that described in Example I. The resulting photosensitive member having two electrically operative layers is subjected to electrical cycling in a continuous rotating scanner for about 50,000 cycles as described in Example I. The results of the scanning test, plotting surface potential to number of cycles, is illustrated in FIG. 4. Curve A shows surface potential about 0.06 second after charging. Curve B shows the surface potential after imagewise exposure about 0.2 second after charging. Curve C shows the surface potential after development about 0.6 second after charging. As evidenced from the curves, the excessive surface potential increase with number of cycles exhibited by the device of Example I was reduced dramatically and rendered the treated photosensitive member acceptable for making quality images under extended cycling conditions in precision, high volume, high speed copiers, duplicators and printers without the need for expensive, sophisticated equipment to compensate for changes in surface charge.

EXAMPLE V

Figure 5:
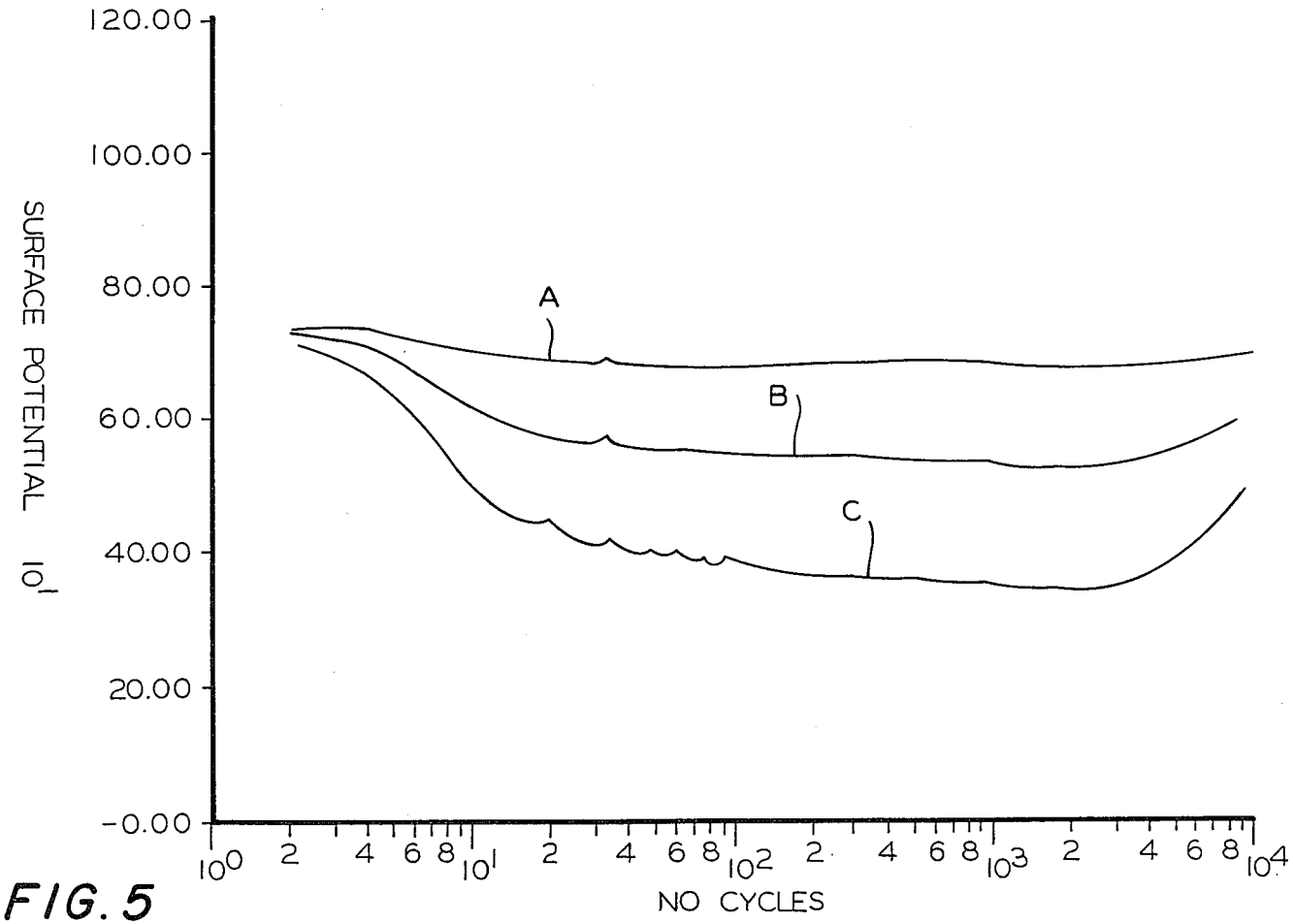
FIG. 5 graphically illustrates the cycling-down characteristics of a photosensitive member having at least two electrically operative layers on a metal oxide layer of a conductive metal anode layer.

A layer of $As_2Se_3$ having a thickness of about 0.15 micrometers was formed on an aluminized polyethylene terephthalate film by conventional vacuum deposition techniques such as those illustrated in U.S. Pat. Nos. 2,753,278 and 2,970,906. A charge transport layer is prepared by dissolving about 7.5 grams of N,N'-diphenyl-N,N'-bis(3-methylphenyl)1,1'-biphenyl-4,4'-diamine in about 85 grams of methylene chloride in about 7.5 grams of bisphenol-a polycarbonate, Lexan, available from General Electric Company. This charge transport material is applied to the $AS_2Se_3$ layer using a Bird Film applicator and thereafter vacuum dried at about 80° C. for about 18 hours to form a 25 micron thick dry layer. This photoreceptor is then evaluated in the continuous rotating scanner described in Example I. FIG. 5 shows the results of extended electrical cycling. Curve A shows surface potential about 0.06 second after charging. Curve B shows the surface potential afer imagewise exposure about 0.2 second after charging. Curve C shows the surface potential after development about 0.6 second after charging. As readily apparent from examining curves B and C, cycling down occurs at a marked rate after only about 4 cycles. This cycling-down characteristic is unacceptable for making quality images in precision high speed, high volume copiers, duplicators, and printers unless expensive sophisticated equipment is employed to compensate for the large change in surface charge.

EXAMPLE VI

Figure 6:
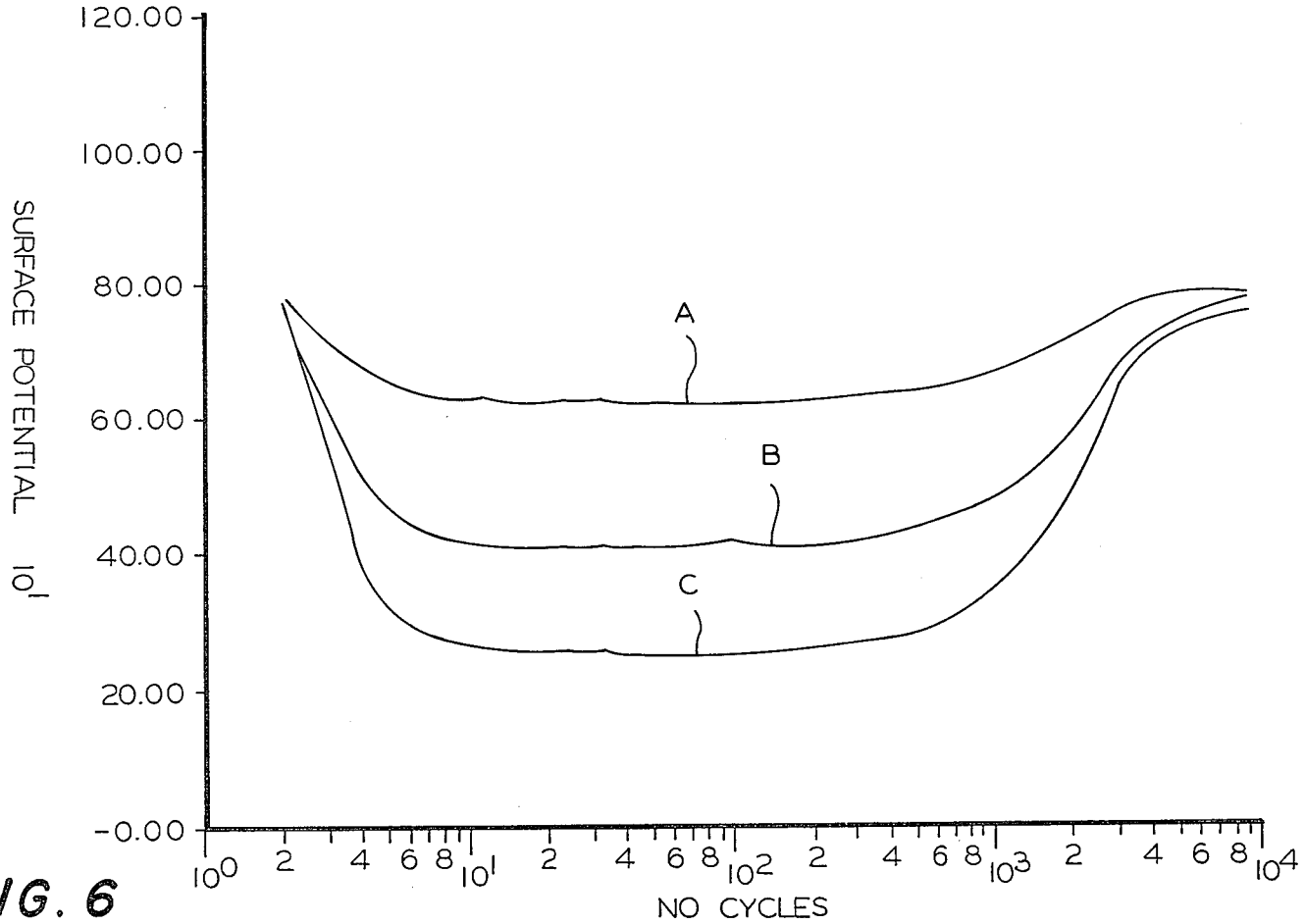
FIG. 6 graphically illustrates the cycling-down characteristics of photosensitive member in which an adhesive layer is interposed between a metal oxide layer of a conductive metal anode layer and at least two electrically operative layers.

A coating of polyester resin, du Pont 49000, available from E. I. du Pont de Nemours & Co. was applied with a 0.0005 inch Bird applicator to the an aluminized polyester film, Mylar, in which the aluminum had a thickness of about 150 Angstroms. The polyester resin coating was dried to form a film having a thickness of about 0.05 micrometers. A layer of $As_2Se_3$ having a thickness of about 0.15 micrometer was formed on the polyester adhesive layer overlying the aluminized polyethylene terephthalate film by conventional vacuum deposition techniques such as those illustrated in U.S. Pat. Nos. 2,753,278 and 2,970,906. A charge transport layer is prepared by dissolving about 7.5 grams of N,N'-diphenyl-N,N'-bis(3-methylphenyl)1,1'-biphenyl-4,4'-diamine in about 85 grams of methylene chloride in about 7.5 grams of bisphenol-a polycarbonate, Lexan, available from General Electric Company. This charge transport material is applied to the $AS_2Se_3$ layer using a Bird Film applicator and thereafter vacuum dried at about 80° C. for about 18 hours to form a 25 micron thick dry layer of hole transport material. This photoreceptor is then evaluated in the continuous rotating scanner described in Example I. FIG. 6 shows the results of extended electrical cycling. As readily apparent from examining curves B and C, cycling down occurs at a marked rate after about 50,000 cycles. Curve A shows surface potential about 0.06 second after charging. Curve B shows the surface potential after imagewise exposure about 0.2 second after charging. Curve C shows the surface potential after development about 0.6 second after charging. As evidenced from the curves, the rapid and excessive cycling-down of surface potential renders the photosensitive member unacceptable for extended life use for making quality images in precision, high speed, high volume, copiers, duplicators and printers without the need for expensive, sophisticated equipment to compensate for changes in surface charge.

EXAMPLE VII

Figure 7:
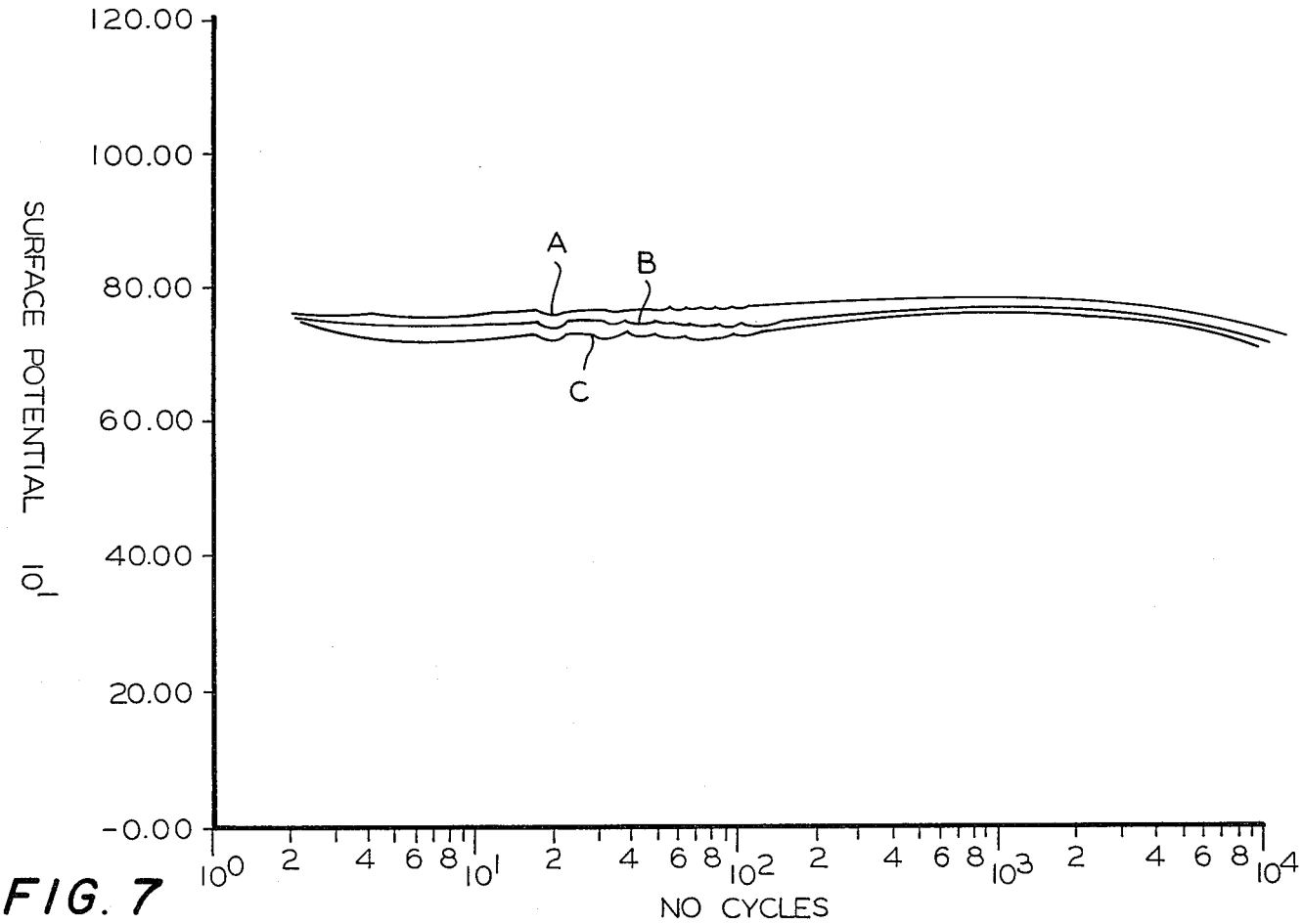
FIG. 7 graphically illustrates the cycling effects of a photosensitive member having a siloxane film interposed between an metal oxide layer of a conductive metal anode layer and two electrically operative layers.

An aqueous solution was prepared containing about 0.44 percent by weight based on the total weight of the solution or 0.002 mole solution, of 3-aminopropyl triethoxylsilane. The solution also contained about 5 percent by weight denatured ethanol and about 5 percent by weight isopropanol based on the total weight of the solution. About 0.0004 mole of hydrogen iodide was added to the solution to bring the pH to about 7.5. This solution was applied with a 0.0005 Bird bar onto the surface of an aluminized polyester film, Mylar, and thereafter dried at a temperature of about 135° C. in a forced air oven for about 3 minutes to form a film of the partially polymerized siloxane upon the aluminum oxide layer of the aluminized polyester film, Mylar, in which the aluminum had a thickness of about 100 micrometers to form a dried siloxane film having a thickness of about 150 Angstroms measured by ellipsometry. The layers described in Example VI beginning with the polyester resin were then applied to the partially polymerized siloxane film on the aluminum oxide layer of the aluminized polyester film using the same procedures as Example VI. This photoreceptor is then evaluated in the continuous rotating scanner described in Example I. FIG. 7 shows the results of extended electrical cycling. Curve A shows surface potential about 0.06 second after charging. Curve B shows the surface potential after imagewise exposure about 0.2 second after charging. Curve C shows the surface potential after development about 0.6 second after charging. As readily apparent from examining curves B and C, cycling-down is virtually eliminated. This stabilization of cycling surface charging characteristics is highly desirable for making quality images in precision high volume, high speed copiers, duplicators, and printers without expensive sophisticated equipment to compensate for the large change in surface charge.

EXAMPLE VIII

A coating of polyester resin, du Pont 49000, available from E. I. du Pont de Nemours & Co. was applied with a 0.0005 inch Bird applicator to the an aluminized polyester film, Mylar, in which the aluminum had a thickness of about 150 Angstroms. The polyester resin coating was dried to form a film having a thickness of about 0.05 micrometers. A slurry coating solution of 0.8 grams trigonal selenium having a particle size of about 0.05 micrometers to 0.2 micrometers and about 0.8 grams of polyvinylcarbazole in about 7 milliliters of tetrahydrofuran and about 7 milliliters toluene was applied with a 0.0005 inch Bird Bar, the layer was dried for about 3 minutes at about 135° C. in a forced air oven to form a hole generating layer having a thickness of about 1.6 micrometers. A charge transport layer is prepared by dissolving about 7.5 grams of N,N'-diphenyl-N,N'-bis(3-methylphenyl)1,1'-biphenyl-4,4'-diamine in about 85 grams of methylene chloride and about 7.5 grams of bisphenol-a polycarbonate, Lexan, available from General Electric Company. This charge transport material is applied to the generating layer using a Bird Film applicator and thereafter dried at about 135° C. for about 3 minutes to form a 25 micron thick dry layer of hole transporting material. This photoreceptor is then evaluated in the continuous rotating scanner described in Example I at 10 percent relative humidity for 100,000 cycles. The cycling-down was about 670 V. The cycling-down value was the change in surface potential from the initiation of testing, the value being determined after development about 0.6 second after charging (e.g. curve C of the graphs FIGS. 1–7) over 80,000 cycles. This dramatic cycling-down change renders this photoreceptor undesirable for precision, high volume, high speed copiers, duplicators and printers.

EXAMPLES IX–XII

Photoreceptors having two electrically operative layers as described in Example VIII were prepared using the same procedures and materials except that a siloxane coating was applied between the polyester layer and the generating layer. The siloxane layer was prepared by applying a 0.22 percent (0.001 mole) solution of 3-aminopropyl triethoxylsilane to the polyester layer with a 0.0015 inch Bird Bar. The deposited coating was dried for various time intervals at 135° C. in a forced air oven. The thickness of the resulting film was 120 Angstroms in every case. The drying times and corresponding cycling-down surface potential after 100,000 cycles of testing in the scanner described in Example I are:

| | Drying time | Cycling Down Voltage |
|---|---|---|
| Exp. IX | 3 min. | 146 volts |
| Exp. X | 15 min. | 110 volts |
| Exp. XI | 75 sec. | 160 volts |
| Exp. XII | 115 sec. | 170 volts |

This stabilization of cycling surface charging characteristics is highly desirable for making quality images in precision high volume, high speed copiers, duplicators, and printers without expensive sophisticated equipment to compensate for the large change in surface charge.

EXAMPLES XIII–XVI

Photoreceptors having two electrically operative layers as described in Example IX were prepared using the same procedures and materials except different silane concentrations of silane and a 0.0005 inch Bird Bar was utilized to apply hydrolyzed silane coating. The drying time was about 5 minutes at about 135° C. in every case. The siloxane film thicknesses, corresponding silane concentrations and corresponding cycling up and down surface potentials after 80,000 cycles of testing in the scanner described in Example I were:

| Example | Silane Concen. | Reaction Product Layer Thickness | Cycling-Down Voltage |
|---|---|---|---|
| Exp. XIII | 0.22% | 80 Angstroms | 160 |
| Exp. XIV | 0.11% | 60 Angstroms | 120 |
| Exp. XV | 0.044% | 40 Angstroms | 100 |
| Exp. XVI | 0.022% | 20 Angstroms | 120 |

These cycling-down surface potential changes are satisfactory for precision, high volume, high speed copiers, duplicators and printers.

EXAMPLE XVII

The same procedures and materials described in Examples XIII–XVI were repeated except that no siloxane film was used. The cycling-down surface potential after 80,000 cycles of testing in the scanner described in Example I was 580 volts. This excessive cycling-down of surface potential renders the photosensitive member unacceptable for extended life use to make quality images in precision, high speed, high volume copiers, duplicators.

EXAMPLE XVIII

Photoreceptors having two electrically operative layers as described in Example XIII were prepared using the same procedures and materials except a silane coating was applied between the polyester layer and the generator layer. The siloxane layer was prepared by applying a 0.44 percent by weight of the total solution (0.002 mole) solution of 3-aminopropyl triethoxylsilane and a 0.44 percent by weight of the total solution (0.002 mole) of acidic acid to the polyester layer with a 0.0005 inch Bird Bar. The deposited coating was dried at 135° C. in a forced air oven. The cycling-down surface potential after 50,000 cycles of testing in the scanner described in Example I was 90 volts at 15 percent relative humidity. This stabilization of surface potential under extended cycling conditions is highly desirable for making quality images in precision, high speed, high volume, copiers, duplicators and printers without the need for extensive sophisticated equipment to compensate for the large change in surface charge.

EXAMPLES XIX–XXIV

Photoreceptors having two electrically operative layers as described in Example XVIII were prepared using the same procedures and materials except different mole ratios of hydriodic acid was substituted for the acidic acid.

| Example | Mole Silane | Mole HI | Cycling-Down Voltage |
|---|---|---|---|
| Exp. XIX | 0.002 | 0.0001 | 100 |
| Exp. XX | 0.002 | 0.0002 | 100 |
| Exp. XXI | 0.002 | 0.0005 | 120 |
| Exp. XXII | 0.002 | 0.001 | 180 |
| Exp. XXIII | 0.002 | 0 | 180 |
| Exp. XXVI | 0.002 | 0 | 360 |

Except for the photoreceptor of Example XXVI, these cycling-down surface potential changes are satisfactory for precision, high volume, high speed copiers, duplicators and printers.

EXAMPLE XXV

Photoreceptors having two electrically operative layers as described in Example II were prepared using the same procedures and quantities of components and materials except that N,N-diethy-3-amino propyltrimethoxy silane was substituted for the 3-aminopropyl triethoxy silane of Example II. The cycling-up surface potential after 10,000 cycles of testing in the scanner described in Example I was 120 volts. The cycling up value was the change in surface potential from initiation of testing, the value being determined after development about 0.6 second after charging, (e.g. curve C of graphs of FIGS. 1–7) over 10,000 cycles. This relative stability the treated photosensitive member renders acceptable for making quality images under extended cycling conditions in high volume, high speed copiers, duplicatiors and printers without the need for expensive, sophisticated equipment to compensate for changes in the surface charge.

EXAMPLE XXVI

Photoreceptors having two electrically operative layers as described in Example II were prepared using the same procedures and quantities of components and materials except that N-methylaminopropyl trimethoxy silane was substituted for the 3-aminopropyl triethoxy silane of Example II. The cycling-up surface potential after 10,000 cycles of testing in the scanner described in Example I was 100 volts. The cycling up value was the change in surface potential from initiation of testing, the value being determined after development about 0.6 second after charging, (e.g. curve C of graphs of FIGS. 1–7) over 10,000 cycles. This relative stability the treated photosensitive member renders acceptable for making quality images under extended cycling conditions in high volume, high speed copiers, duplicatiors and printers without the need for expensive, sophisticated equipment to compensate for changes in the surface charge.

EXAMPLE XXVII

Photoreceptors having two electrically operative layers as described in Example II were prepared using the same procedures and quantities of components and materials except that bis(2-hydroxyethyl)aminopropyltriethoxy silane was substituted for the 3-aminopropyl triethoxy silane of Example II. The cycling-up surface potential after 10,000 cycles of testing in the scanner described in Example I was 180 volts. The cycling up value was the change in surface potential from initiation of testing, the value being determined after development about 0.6 second after charging, (e.g., curve C of graphs of FIGS. 1–7) over 10,000 cycles. The relative stability the treated photosensitive member renders acceptable for making quality images under extended cyling conditions in high volume, high speed copiers, duplicatiors and printers without the need for expensive, sophisticated equipment to compensate for changes in the surface charge.

EXAMPLE XXVIII

Photoreceptors having two electrically operative layers as described in Example II were prepared using the same procedures and quantities of components and materials except that N-trimethoxysilyl propyl-N,N-dimethyl ammonium acetate was substituted for the 3-aminopropyl triethoxy silane of Example II. The cycling-up surface potential after 10,000 cycles of testing in the scanner described in Example I was 30 volts. The cycling up value was the change in surface potential from initiation of testing, the value being determined after development about 0.6 second after charging, (e.g. curve C of graphs of FIGS. 1–7) over 10,000 cycles. This relative stability the treated photosensitive member renders acceptable for making quality images under extended cyling conditions in high volume, high speed copiers, duplicatiors and printers without the need for expensive, sophisticated equipment to compensate for changes in the surface charge.

EXAMPLE XXIX

Photoreceptors having two electrically operative layers as described in Example II were prepared using the same procedures and quantities of components and materials except that N-trimethoxysilylpropyl-N,N,N,-trimethyl chloride was substituted for the 3-aminopropyl triethoxy silane of Example II. The cycling-up surface potential after 10,000 cycles of testing in the scanner described in Example I was 10 volts. The cycling up value was the change in surface potential from initiation of testing, the value being determined after development about 0.6 second after charging. (e.g. curve C of graphs of FIGS. 1–7) over 10,000 cycles. This relative stability the treated photosensitive member renders acceptable for making quality images under extended cyling conditions in high volume, high speed copiers, duplicatiors and printers without the need for expensive, sophisticated equipment to compensate for changes in the surface charge.

EXAMPLES XXX–XXXI

The procedures and materials described in Example VIII were repeated except that different metal anode electrodes were substituted for the aluminum electrode of Example VIII and the number of testing cycles in the continuous rotating scanner was 10,000 cycles instead of 100,000.

| Example | Conductive Metal Anode Material | Conductive Metal Anode Thickness | Conductive Metal Anode Support | Cycling Down Voltage |
|---|---|---|---|---|
| Exp. XXX | nickel | 120 micrometers | none | 300 volts |
| Exp. XXXI | chromium | 200 Angstroms | Mylar film | 260 volts |

These photoreceptors without the siloxane film of this invention exhibited cycling-down surface potential undesirable for precision, high volume, high speed copiers, duplicatiors and printers.

EXAMPLE XXXII

The procedures and materials described in Example VIII were repeated except that different metal anode electrodes were substituted for the aluminum electrode of Example VIII and the number of testing cycles in the continuous rotating scanner was 10,000 cycles instead of 100,000.

| Example | Conductive Metal Anode Material | Conductive Metal Anode Thickness | Conductive Metal Anode Support | Cycling Down Voltage |
|---|---|---|---|---|
| Exp. XXXII | nickel | 120 micrometers | none | 160 volts |
| Exp. XXXIII | chromium | 200 Angstroms | Mylar film | 80 volts |

These photoreceptors treated with the siloxane film of this invention exhibited significantly less cycle-down than corresponding untreated photoreceptors described in Examples XXX and XXXI above. These treated photoreceptors exhibited acceptable electrical performance for high volume, high speed copiers, duplicators and printers.

Although the invention has been described with reference to specific preferred embodiments, it is not intended to be limited thereto, rather those skilled in the art will recognize that variations and modifications may be made therein which are within the spirit of the invention and within the scope of the claims.

I claim:

1. A process for preparing an electrostatographic imaging member capable of accepting a negative electrostatic charge, said member having an imaging surface and comprising at least two electrically operative layers comprising a charge transport layer and a contiguous charge generating layer overlying a film comprising a siloxane reaction product of a hydrolyzed silane having reactive OH and ammonium groups attached to silicon atoms of said siloxane, said film being contiguous to a metal oxide layer of a conductive metal anode layer, said conductive anode layer being on one side of said two electrically operative layers and said imaging surface being on the opposite side of said two electrically operative layers, comprising providing a hydrolyzed silane having the general formula selected from the group consisting of:

I

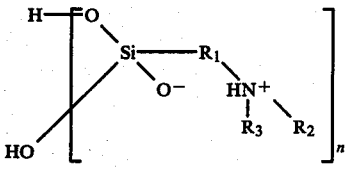

II

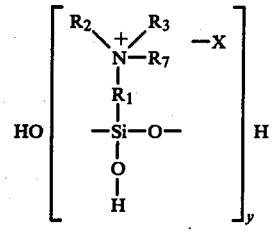

and mixtures thereof, wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, $R_7$ is selected from the group consisting of H, a lower alkyl group containing 1 to 3 carbon atoms and a phenyl group, X is an anion from an acid or acidic salt, n is 1, 2 3 or 4, and y is 1, 2, 3 or 4 in sufficient water to form an aqueous solution while maintaining said aqueous solution at a pH between about 4 and about 10 with an acidic composition selected from the group consisting of an acid, acidic salt and mixtures thereof, contacting said metal oxide layer of said conductive anode layer with said aqueous solution to form a coating, drying said coating to form a film of said siloxane reaction product on said metal oxide layer, and applying said two electrically operative layers to said film.

2. A process for preparing an imaging member according to claim 1 including preparing said hydrolyzed silane by hydrolyzing a hydrolyzable silane having the general formula:

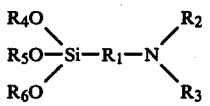

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$ and $R_6$ are independently selected from a lower alkyl group containing 1 to 4 carbon atoms in sufficient water to form an aqueous solution while maintaining said aqueous solution at a pH between about 4 and about 10.

3. A process for preparing an imaging member according to claim 1 including maintaining said aqueous solution at a pH between about 4 and about 10 with an acidic composition selected from the group consisting of organic acids, inorganic acids, organic acidic salts, inorganic acidic salts and mixtures thereof.

4. A process for preparing an imaging member according to claim 1 including maintaining said aqueous solution at a pH between about 7 and about 8 with an acidic composition.

5. A process for preparing an imaging member according to claim 1 wherein said aqueous solution comprises from about 0.1 percent by weight to about 1.5 percent by weight hydrolyzable silane based on the total weight of said aqueous solution prior to hydrolyzing said silane.

6. A process for preparing an imaging member according to claim 1 wherein said aqueous solution comprises from about 0.05 percent by weight to about 0.2 percent by weight hydrolyzable silane based on the total weight of said aqueous solution prior to hydrolyzing said silane.

7. A process for preparing an imaging member according to claim 1 wherein said reaction product has a thickness of between about 10 Angstroms and about 2,000 Angstroms after drying said coating.

8. A process for preparing an imaging member according to claim 1 wherein said aqueous solution contains a nonaqueous polar solvent.

9. A process for preparing an imaging member according to claim 9 wherein said nonaqueous polar solvent is ethanol.

10. An imaging member capable of accepting a negative electrostatic charge, said member having an imaging surface and comprising at least two electrically operative layers comprising a charge transport layer and a contiguous charge generating layer overlying a film comprising a siloxane dried reaction product of a hydrolyzed silane having reactive OH and ammonium groups attached to silicon atoms of said siloxane, said film being contiguous to a metal oxide layer of a conductive metal anode layer, said conductive anode layer being on one side of said two electrically operative layers, said imaging surface being on the opposite side of said two electrically operative layers, said hydrolyzed silane having the general formula selected from the group consisting of:

I

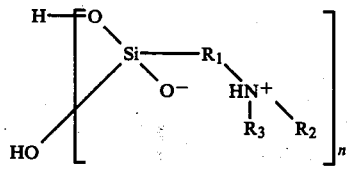

II

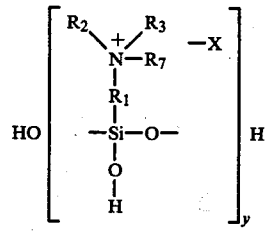

and mixtures thereof, wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, $R_7$ is selected from the group consisting of H, a lower alkyl group containing 1 to 3 carbon atoms and a phenyl group, X is an anion from an acid or acidic salt, n is 1, 2 3 or 4 and y is 1, 2, 3 or 4.

11. An imaging member comprising a charge generating layer and a contiguous charge transport layer overlying a layer comprising a reaction product between a hydrolyzed silane and a metal oxide layer of a conductive anode layer, said hydrolyzed silane having the general formula:

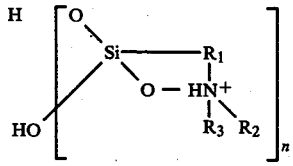

or

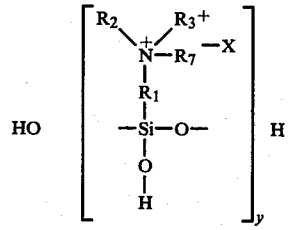

and mixtures thereof, wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, n is 1, 2 or 3, and y is 1, 2, 3 or 4, said imaging member exhibiting the capabilty of accepting a uniform negative electrostatic charge prior to imagewise exposure.

12. An imaging member according to claim 11 wherein said charge transport layer comprises a polycarbonate resin having a molecular eight of from about 20,000 to about 120,000 having disperersed therein from about 25 to about 75 percent by weight of one or more compounds having the general formula:

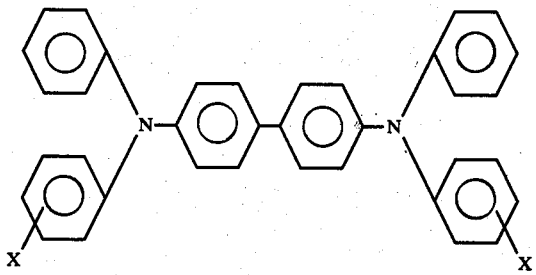

wherein X is selected from the group consisting of an alkyl group having from 1 to about 4 carbon atoms and chlorine, said charge generating layer exhibiting the capability of photogeneration of holes and injection of said holes and said charge transport layer is substantially nonabsorbing in the spectral region at which said charge generating layer generates and injects photogenerated holes but is capable of supporting the injection of photogenerated holes from said charge generating layer and transporting said holes through said charge transport layer.

13. An imaging member according to claim 12 wherein said polycarbonate resin is poly(4,4'-isopropylidene-diphenylene carbonate).

14. An imaging member according to claim 12 wherein said polycarbonate resin has a molecular weight between from about 25,000 and about 45,000.

15. An imaging member according to claim 12 wherein said polycarbonate resin has a molecular weght between from about 50,000 to 120,000.

16. An imaging member according to claim 11 wherein said charge generating layer comprises photoconductive material selected from the group consisting of amorphous selenium, trigonal selenium, and selenium alloys selected from the group consisting of selenium-tellurium, selenium-tellurium-arsenic, selenium-arsenic, and mixtures thereof.

17. An imaging member according to claim 11 wherein said charge generating layer comprises photoconductive particles dispersed in a resinous binder.

18. An imaging member according to claim 11 wherein said charge generating layer comprises photoconductive particles dispersed in polyvinylcarbazole.

19. An imaging member according to claim 11 wherein said charge generating layer comprises photoconductive particles dispersed in a resinous binder material comprised of a poly(hydroxyether) material selected from the group consisting of those of the following formulas:

I.

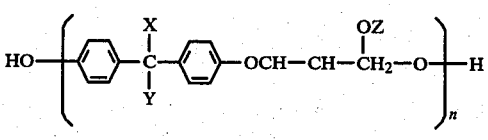

-continued and

II:

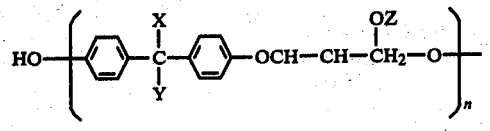

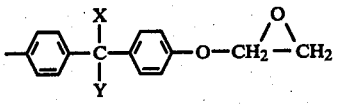

wherein X and Y are independently selected from the group consisting of aliphatic groups and aromatic groups, Z is hydrogen, and aliphatic groups, or an aromatic groups, and n is a number of from about 50 to about 200.

20. An electrophotographic imaging process comprising providing an imaging member having an imaging surface and comprising at least two electrically operative layers comprising a charge generating layer and a contiguous charge transport layer said electrically operative layers overlying a film comprising a siloxane reaction product of a hydrolyzed silane having reactive OH and ammonium groups attached to silicon atoms said film being contiguous to a metal oxide layer of a conductive metal anode layer, said conductive anode layer being on one side of said two electrically operative layers and said imaging surface being on the opposite side of said two electrically operative layers, said hydrolyzed silane having the general formula selected from the group consisting of:

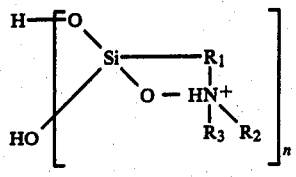

or

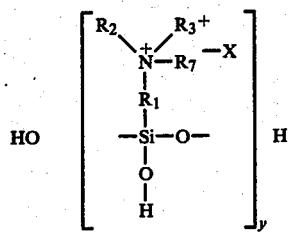

and mixtures thereof, wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, $R_7$ is selected from the group consisting of H, a lower alkyl group containing 1 to 3 carbon atoms and a phenyl group, X is an anion from an acid or acidic salt, n is 1, 2, 3, or 4, and y is 1, 2, 3, or 4, said imaging member exhibiting the capabilty of accepting a uniform negative electrostatic charge prior to imagewise exposure, repeatedly depositing a uniform negative electrostatic charge on said imaging surface and discharging said imaging surface to drive metal cations from said conductive metal anode layer toward said imaging surface, and reacting said cations with said reactive OH and ammonium groups attached to said silicon atoms.

* * * * *